US005516161A

United States Patent [19]

Mader et al.

[11] Patent Number: 5,516,161

[45] Date of Patent: May 14, 1996

[54] BREAKAWAY LEVER CLUTCH WITH CAM DRIVE PIN

[75] Inventors: Gerald E. Mader, Indianapolis; Paul J. Haeck, Carmel, both of Ind.

[73] Assignee: Von Duprin, Inc., Indianapolis, Ind.

[21] Appl. No.: 173,321

[22] Filed: Dec. 27, 1993

[51] Int. Cl.[6] ..... E05C 1/12

[52] U.S. Cl. ..... 292/34; 292/DIG. 27; 292/169.17; 70/224; 70/422; 70/475; 70/489

[58] Field of Search ..... 70/224, 422, 471, 70/472, 475, 476, 478, 487, 489; 292/34, DIG. 27, 169.14, 169.17

[56] References Cited

U.S. PATENT DOCUMENTS

| | | | |
|---|---|---|---|
| 2,218,183 | 10/1940 | Springer | 292/DIG. 27 |
| 2,497,329 | 2/1950 | Smith et al. | 292/DIG. 27 |
| 4,108,482 | 8/1978 | Dietrich et al. | 292/DIG. 27 |
| 4,390,195 | 6/1983 | Cox et al. | 292/DIG. 27 |
| 4,394,821 | 7/1983 | Best et al. | 70/422 |
| 4,429,556 | 2/1984 | Kambic | 70/472 |
| 4,773,240 | 9/1988 | Foshee | 70/422 |
| 5,010,755 | 4/1991 | Best | 70/422 |
| 5,040,652 | 8/1991 | Fish et al. | 70/422 |

*Primary Examiner*—Darnell M. Boucher
*Attorney, Agent, or Firm*—Robert F. Palermo; A. James Richardson

[57] ABSTRACT

A door lever assembly having a locked and an unlocked position includes a trim housing and a lever handle rotatably connected to the trim housing. A cam is rotatably connected to the trim housing, and a pin mechanism is movably positionable to connect with the lever handle. A slider is attached for movement in the trim housing in response to rotation of the cam, anda lift arm is connected to the slider. The lift arm is rigidly movable with the slider when the door lever assembly is in its unlocked position and the lever handle is rotated. When the door lever assembly is in its locked position, the lift arm pivots toward the cam to disengage the pin mechanism from its connection between the lever handle and the cam.

13 Claims, 6 Drawing Sheets

BREAKAWAY LEVER CLUTCH WITH CAM DRIVE PIN

BACKGROUND OF THE INVENTION

The present invention relates to a door lever assembly that resists vandalism and breakage. More specifically, the present invention relates to single or double door lever assembly having a breakaway door handle rotatably connected to a cam propelled slider for operating a door latch, and a key cylinder lock mechanism for blocking operation of the slider.

Conventional door levers having a fixed lock position are subject to damage by vandals or those seeking unauthorized entry into commercial or public buildings. A locked door lever extending outward in a substantially horizontal position can be impacted with hammers or other devices to break the lever or shatter lock components. In addition, it is sometimes possible to use the weight of a person seeking entry to downwardly force a door lever and break the lock mechanism. To partially overcome this problem, certain door levers are designed to have shear spins or other elements for designed failure that break and render the lever mechanism inoperable after application of undue force.

For example, a conventional door lever typically has a trim housing configured to accommodate a key cylinder lock above a rotatable lever handle that is operably connected to a door latch mechanism. The lever handle is permanently pinned to a shaft that extends inward to engage an eccentrically configured cam. The cam can be rotated to upwardly move a slider plate that is in turn connected to a lift arm. Movement of the lift arm in turn causes movement of vertically directed rods that are connected to retract a door latch. Locking this assembly simply requires rotation of the key cylinder to engage a blocking slide known as a trim lock tumbler that prevents movement of the lift arm, and consequently fixes the slider, cam, shaft, and door lever in a fixed and locked position.

However, with this type of assembly the door lever handle is fixed (in its locked position) to extend horizontally outward. To prevent permanent damage to the lock mechanism, a shear spin is provided to connect cam and the shaft. Application of excessive torque forces to the lever handle causes failure of the shear pin, effectively disconnecting the lever and attached shaft from the remaining elements of the door lever assembly. Although this protects the remaining lock elements from further damage, it does require removal of the trim housing and replacement of the shear pin to restore lever function.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this and other problems are overcome by providing a novel breakaway lever assembly for disengaging an unlocked latch of a lockable door latch assembly. The lockable door latch assembly has an unlocked and a locked position, with vertical rods movable in the unlocked position to release a door latch, and a blocking slide movable to the locked position to prevent movement of a lift arm connected by way of vertical rods to the door latches. The novel breakaway lever assembly controls engagement of the door lever assembly by provision of a lever handle rotatably connected to a trim housing and its attached stop plate. A cam is operably connected to the lever handle, with rotation of the cam resulting in linear movement of both a slider and a connected lift arm.

A breakaway pin mechanism is movably positionable to connect the lever handle and the cam. The pin mechanism ensures rotation of the cam as the lever handle is rotated when the door lever assembly is unlocked. However, when the door lever assembly is locked, the lift arm is prevented from rigidly moving with the slider, and instead overcomes resistance of an over-ride spring to pivot toward the cam and disengage the pin mechanism from its connection between the lever handle and the cam. The over-ride spring is connected between the slider and a lift arm, with the over-ride spring transmitting motion of the slider to the lift arm when the door lever assembly is in its unlocked position, and compressing in response to slider movement when the door lever assembly is in its locked position.

The foregoing and other aspects will become apparent from the following detailed description of the invention when considered in conjunction with the accompanying drawing figures.

DETAILED DESCRIPTION

Figure 1:
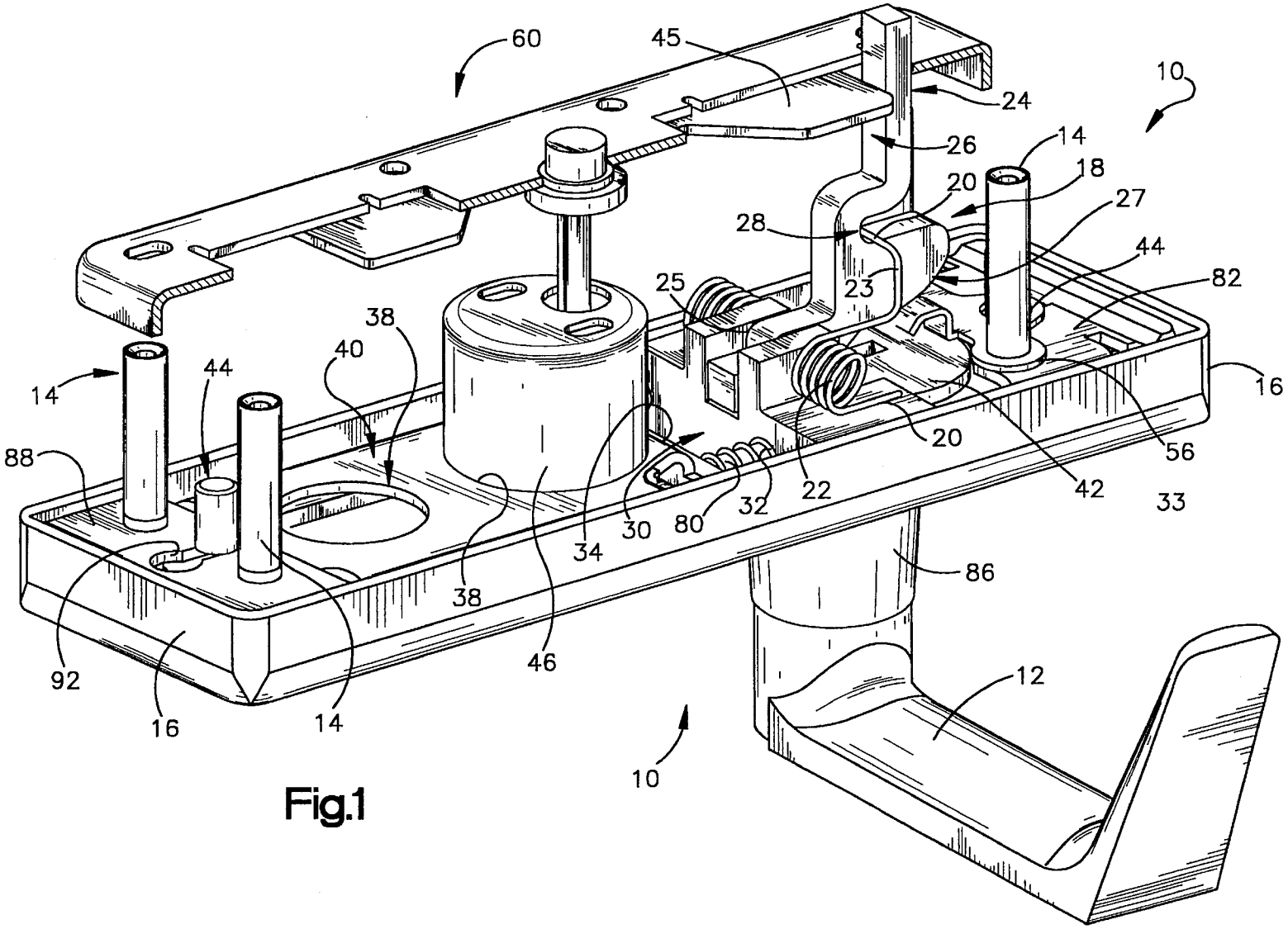
FIG. 1 is a perspective view of a door lever assembly in accordance with the present invention, showing an outwardly extending lift arm for engagement with a door latch assembly, an over-ride spring assembly positioned adjacent to the lift arm, and a door lever handle in its horizontally outward extending position.

As illustrated in FIG. 1, a door lever assembly 10 for use in single or double door applications requiring breakaway lever action includes a lever handle 12 rotatably coupled by a bushing sleeve 86 to a trim housing 16. The trim housing 16 is formed from a stamped, non-machined metal, and has a pair of weld studs 44 electrically welded at opposite ends to the trim housing 16.

Figure 2:
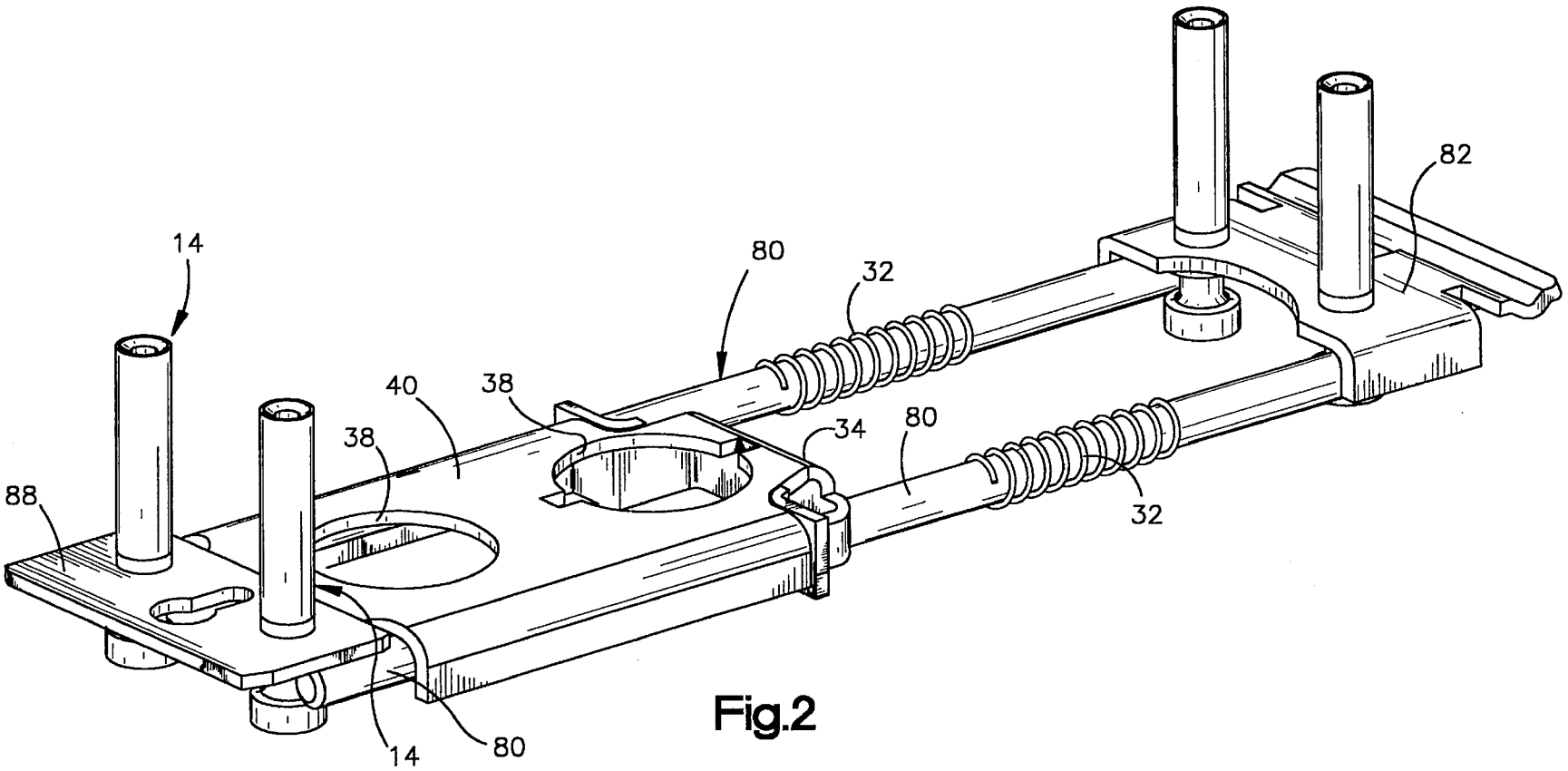
FIG. 2 is a perspective view of fixed guide rods, plates, and front and end blocks,that are immovably positioned within the trim housing to support a linearly movable slide such as shown in FIG. 1.

As best seen by consideration of FIGS. 1 and 2, several components are fixed within the trim housing 16, including a pair of guide rods 80 held by a front block 88 and an end block 82. The guide rods 80 are of cylindrically shaped metal construction, and are dimensioned to snugly fit longitudinally within the trim housing 16, with each end adjacent to an edge of the trim housing 16. As will be appreciated from consideration of the Figures, the guide rods 80 retain and properly position other components of the door lever assembly 10, including a plate 40 with its door lock apertures 38 and integrally defined turned edge that forms stop plate 34.

Extending respectively through the front block 88 and end block 82 are mounting studs 14. Each mounting stud 14 engages either the front block 88 or end block 82 to hold the blocks 88 or 82 a predetermined distance apart from the trim housing 16. In addition, each mounting stud is knurled to provide a space to conformably accommodate the guide rods 80. The blocks 88 and 82 are also respectively provided with key hole slots 92 that hold the blocks in position in the trim housing by engagement with the weld studs 44.

Figure 6:
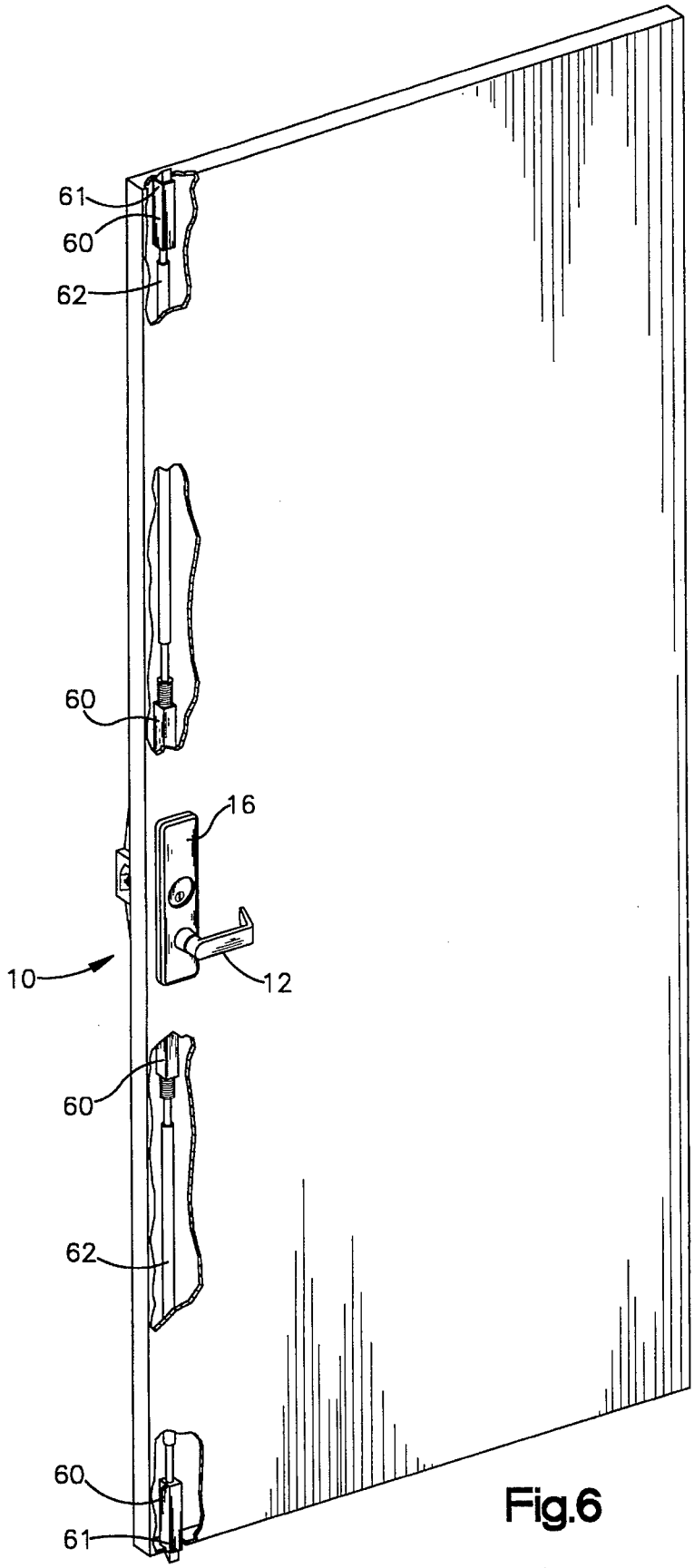
FIG. 6 is a perspective view of a door lever assembly accommodated in latchable door, with the door partially broken away to indicate vertically extending rods in the door that are movable in response to rotation of the unlocked door lever assembly.

In contrast to the foregoing fixed components, the door lever assembly 10 includes a number of interconnected linearly movable or rotatable components. For example, when unlocked, turning a lever handle 12 of conventional design results in rotation of an eccentrically configured cam 42, which in turn linearly moves a slider 30 and its connected lift arm 24 to retract door latches 61. The lift arm 24 moves components of a door latch assembly 60 (See FIGS. 1 and 6), including connected vertical rods 62 that operate retraction or extension of door latches 61. The door lever assembly 10 controls the lock/unlocked position of the door latch assembly 60 using a conventional key cylinder 46 that extends through the trim housing 16 to engage a conventional blocking slide 45 of the door latch assembly 60. The blocking slide 45 is moved upward or downward by rotation of the key cylinder 46. When the blocking slide 45 is positioned in an unlocked, upward position (position not indicated in the Figures), linear movement upward of the lift arm 24 is not impeded. However, when the blocking slide 45 is positioned in a downward, locked position, linear movement of the lift arm 24 is impeded.

As those skilled in the art will appreciate, construction of the lift arm 24 can be varied to accommodate various embodiments of the invention. However, the lift arm 24 will typically be constructed from a single integral piece of metal to have a flat lock engaging portion 26, a spring engaging portion 28 immediately adjacent to an outwardly extending lobe 27, and a pivot engaging portion 25 rotatably attached by a pivot pin 29 to the slider 30. The lock engaging portion 26 engages the blocking slide 45 of the door latch assembly 60 when the blocking slide 45 is positioned in its locked position.

The lift arm 24 is not connected to the slider 30 solely by the pivot pin 29. In addition, the spring engaging portion 28 of the lift arm is attached to the linearly movable slider 30 by an over-ride assembly 18 that includes an over-ride spring 20. The over-ride spring 20 includes first and second coils 21 and 22 held in compressive engagement with the slider 30. The coils 21 and 22 are connected by a connector 23 that engages the spring engaging portion 28 of the lift arm 26. The over-ride spring 20 is typically configured to have a high spring constant, and under normal operating torque is preloaded with sufficient force to be essentially inelastic. However, when sufficiently high forces are exerted the preload force will be overcome and the over-ride spring 20 will begin to compress in response to relative movement of the lift arm and slider. As will be appreciated by those skilled in the art, the exact spring material and configuration can be varied, and it is even possible to use elastomeric materials in place of coiled springs as necessary.

The slider 30 is a generally flat plate constrained for movement along the guide rods 80, and in normal operation is vertically movable within the trim housing 16. Vertical movement of the slider is indirectly promoted by rotational movement of the eccentrically configured cam 42, which causes an integrally defined cam wing 43 to rotate counterclockwise, upwardly pushing the slider 30 in a direction indicated by arrow 31, and in turn upwardly impelling the lift arm 24. Opposing upward movement of the slider 30 are dual lift springs 32 fitted over the guide rods 80 to lie between the slider 30 and plate 40. The lift springs 32 are biased to normally push the slider 30 downward, away from the plate 40. This downward impulse acts to rotate the cam 42 clockwise. This rotation of the lever 10 will also propel the slider 30 in the direction indicated by the arrow 31.

Figure 4:
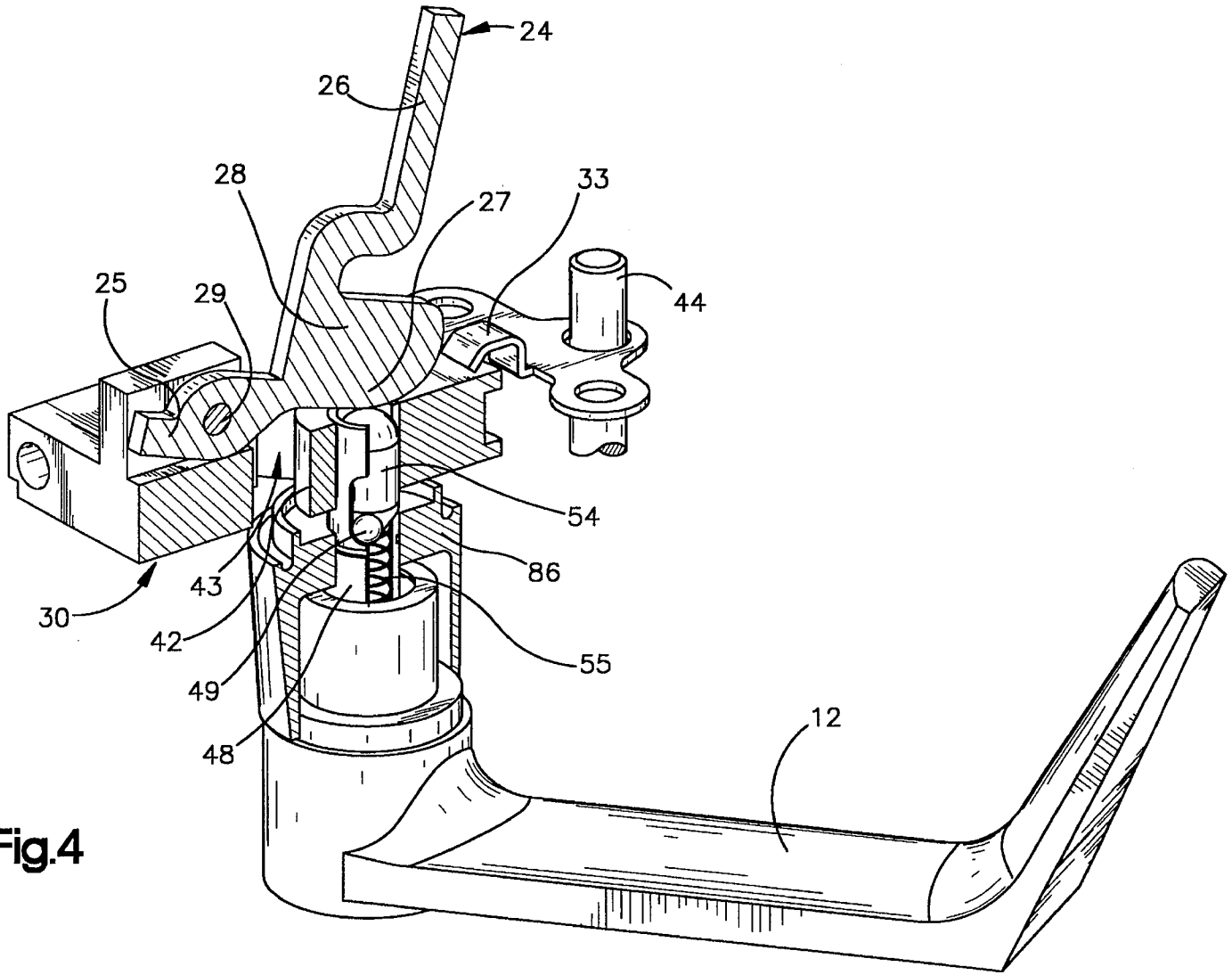
FIG. 4 is broken away perspective view of a pin mechanism providing a breakaway connection between the cam and the door lever handle.
Figure 5:
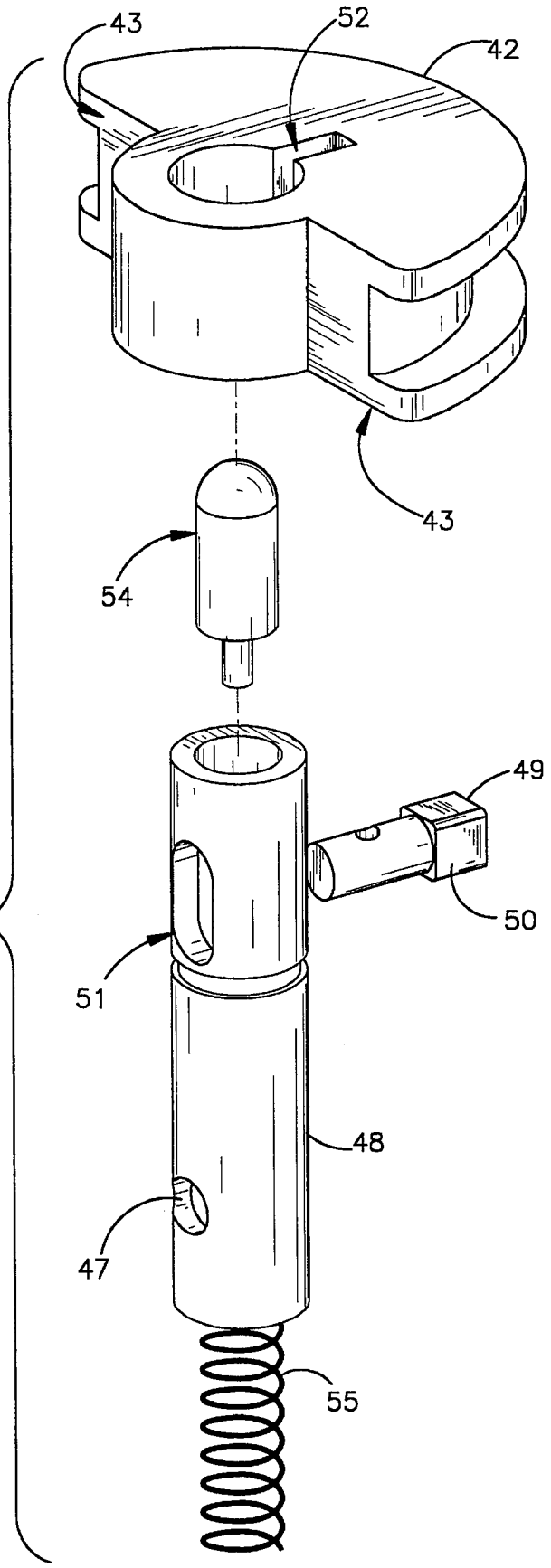
FIG. 5 is an exploded perspective view of a shaft for connection to the door lever, with a movable shear pin, plunger, and reset spring for controlling connection with the cam being indicated.

In normal operation, the cam 42 is rigidly coupled to rotate in response to rotation of the lever handle 12 by the combination of a shaft 48, shear pin 49, plunger 54, and reset spring 55. As best seen in FIGS. 4 and 5, the shear pin 50 is fitted into a shear pin connection groove 51 defined by the shear pin 49. A rectangular, flat edged portion 50 of the shear pin 49 extends perpendicularly outward from the hollow shaft 48 to engage flat edged walls 52 defined in the cam 42. The shear pin 49 is held in place by a plunger 54 that has a hemispherical head capable of extending longitudinally outward from the shaft 48. The shear pin 49 is also supported by a reset spring 55 connecting the shear pin and lever handle 12. The shear pin 49 consequently "floats" within the shaft 48, being longitudinally movable within the shaft in response to force applied to the hemispherical head of the plunger 54. Normally, the reset spring 55 is biased to ensure that the shear pin is engaged with the flat edge walls 52 of the cam 42, so that rotation of the shear pin necessarily rotates the cam 42. However, if the reset spring 55 is depressed as a result of depression of the plunger 54, the shear pin 49 will drop out of contact with the flat edged walls 52 of the cam 42, disengaging the rotating the lever handle 12 from the cam 42.

Figure 3:
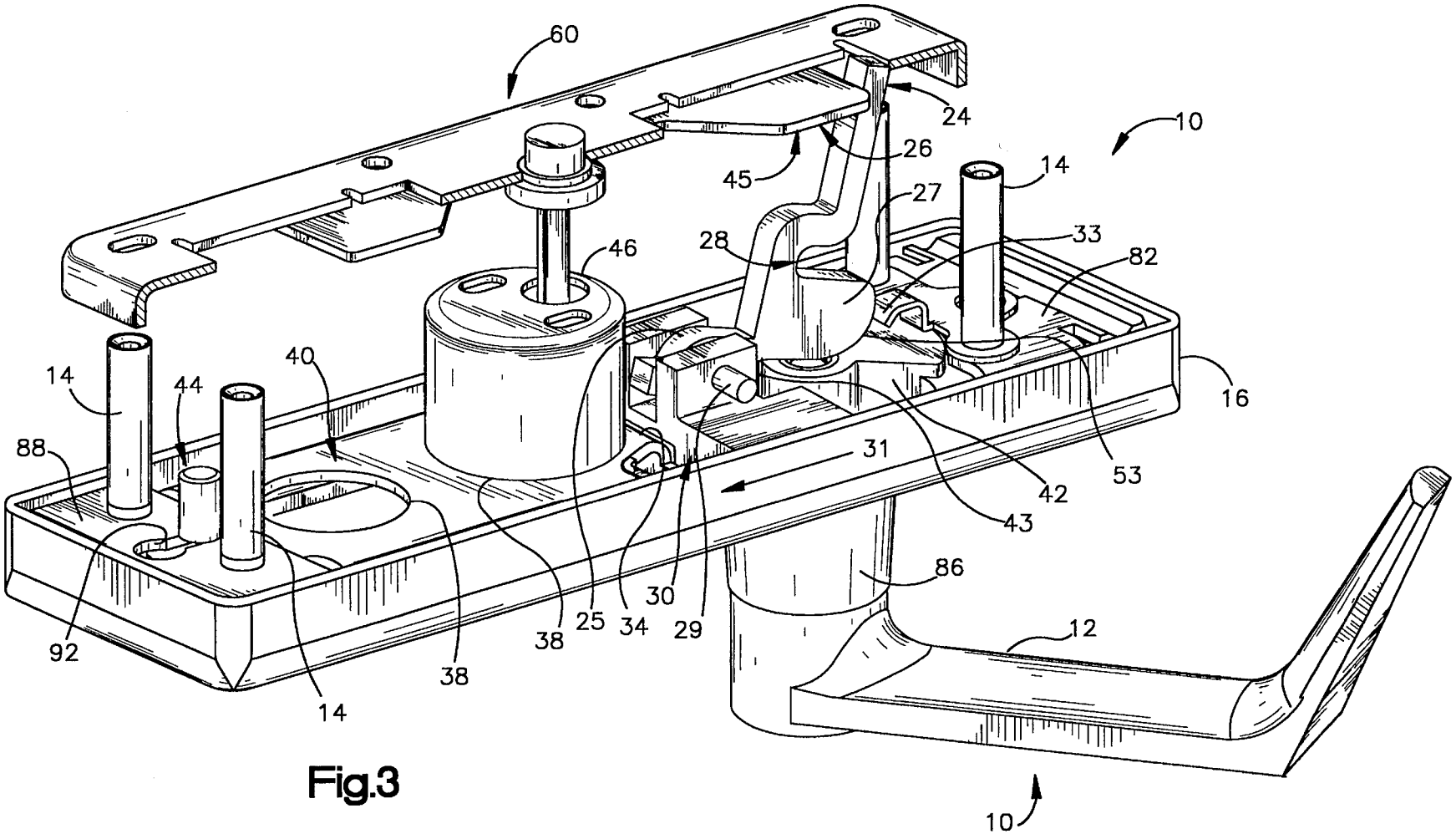
FIG. 3 is a broken away perspective view of the door lever assembly in its locked position, showing orientation of the lift arm as it pivots toward a cam when the slide moves toward a stop plate.

As illustrated in FIG. 1, when the key cylinder 46 is turned the blocking slide 45 is downwardly forced to capture the lock engaging portion 26 of the lift arm 24. This effectively locks the door lever assembly 10, and ordinarily would prevent movement of the lever handle 12 under application of normal handle turning force. However, if abnormally high turning forces are applied to the lever handle 12, the cam 42 will rotate, forcing the slider 30 upward toward the plate 40. As best seen in FIG. 3, the movement of slider 30 causes the lift arm 24 to pivot about its connection to the slider 30 (pivot pin 29), against the resistance over-ride spring 20. Continued rotation of the lever handle 12 further compresses the over-ride spring 20, and also causes lobe 27 of the lift arm 24 to depress a leaf spring 33. Eventually, continued movement of the slider 30 causes the lobe 27 of the lift arm 24 to slip off the leaf spring 33, snapping the lobe 27 toward the cam 42, where the lobe 27 strikes the plunger 54.

When the plunger 54 is struck by the lobe 27 of the lift arm 24, the plunger 54 moves into the hollow shaft 48, displacing and driving the shear pin 49 out of its connection with the shaft 48. This effectively disengages the combined lever and shaft from the cam 42, preventing damage to the door lever assembly 10. However, resetting the shear pin 49 to its original position merely requires returning the lever handle 12 back to its original position, which permits the reset spring 55 to force the shear pin 49 back into position in the cam 42.

Advantageously, the present invention allows the normal operation and use of a door lever assembly that is substantially identical to conventional door lever assemblies when normal forces are exerted. However, when excessive forces are exerted against the door lever handle, such as applied in attempts to force a door lock or vandalize, in a locked position the present mechanism disengages the lever from the cam by retraction of the shear pin into the shaft to prevent damage to the door lever assembly. There will be typically no need to rely on shear pin failure to prevent damage to the locked door lever assembly. As compared to conventional devices, the improved shear pin design and placement make shear pin failure both easier to rely upon and easier to replace.

While the present invention has been described in connection with specific embodiments, it will be apparent to those skilled in the art that various changes may be made therein without departing from the spirit or scope of the invention.

What is claimed is:

1. A door lever assembly having a locked and an unlocked position, the door lever assembly comprising:

a trim housing;

a lever handle rotatably connected to the trim housing;

a cam rotatably connected to the trim housing;

a pin mechanism movably positionable to connect the lever handle and the cam to cause rotation of the cam as the lever handle is rotated;

a slider attached for movement in the trim housing in response to rotation of the cam;

a lift arm connected to the slider, with the lift arm rigidly moving with the slider when the door lever assembly is in its unlocked position and the lever handle is rotated, and with the lift arm pivoting toward the cam to disengage the pin mechanism from its connection between the lever handle and the cam when the door lever assembly is in its locked position.

2. The door lever assembly of claim 1, further comprising:

an over-ride spring connected between the slider and the lift arm, with the over-ride spring transmitting motion of the slider to the lift arm to lift the lift arm when the door lever assembly is in its unlocked position, and with the over-ride spring compressing in response to slider movement when the door lever assembly is in its locked position.

3. The door lever assembly of claim 1, further comprising a shaft attached between the lever handle and the cam, with a pin attaching the shaft to the cam, the pin being movably connected to a reset spring positioned within the shaft.

4. The door lever assembly of claim 3, further comprising a plunger positioned within the shaft to partially extend outward from the shaft, the plunger movably positioned for depression into the shaft to disengage the pin in response to contact between the plunger and the lift arm.

5. The door lever assembly of claim 3, wherein the pin extends perpendicularly outward from the shaft in only one direction to engage the cam.

6. The door lever assembly of claim 1, wherein the slider is linearly movable in response to cam rotation, and further comprising a stop plate attached to the trim housing, and a compressible lift spring positioned between the stop plate and the slider for compression as the slider moves toward the stop plate and expansion away from the stop plate to return the lever handle to an initial position upon release of the lever handle.

7. The door lever assembly of claim 1, wherein the lift arm further comprises a lobe engagable with a leaf spring attached to the trim housing, with the lobe of the lift arm disengaging from the leaf spring to strike the pin mechanism as the slider is moved in response to cam rotation when the door lever assembly is in its locked position.

8. A door lever assembly having a locked and an unlocked position, the door lever assembly comprising:

a trim housing;

a lever handle rotatably connected to the trim housing;

a cam rotatably connected to the trim housing; means for connecting the cam and the lever handle, the connecting means being movably positionable to connect the lever handle and the cam to cause rotation of the cam as the lever handle is rotated;

means for sliding attached for movement in the trim housing in response to rotation of the cam;

means for lifting connected to the sliding means, with the lifting means rigidly moving with the sliding means when the door lever assembly is in its unlocked position and the lever handle is rotated, and with the lifting means pivoting toward the cam to disengage the connecting means from its connection between the lever handle and the cam when the door lever assembly is in its locked position.

9. The door lever assembly of claim 8, further comprising:

means for elastically connecting the sliding means and the lifting means, with the elastic connecting means transmitting motion of the sliding means to the lifting means to lift the door lever assembly when the door lever assembly is in its unlocked position, and with the elastic connecting means compressing in response to movement of the sliding means when the door lever assembly is in a locked position.

10. The door lever assembly of claim 8, wherein the connecting means further comprises a shaft attached between the lever handle and the cam, with a pin attaching the shaft to the cam, the pin being movably connected to a reset spring for movement within the shaft.

11. The door lever assembly of claim 10, further comprising a plunger positioned within the shaft to partially extend outward from the shaft, the plunger movably positioned for depression into the shaft to disengage the pin in response to contact between the plunger and the lifting means.

12. The lever assembly of claim 8, wherein the sliding means is linearly movable in response to cam rotation, and further comprising a stop plate attached to the trim housing, and a compressible lift spring positioned between the stop plate and the slider for compression as the slider moves toward a stop plate and expansion away from the stop plate to return the lever handle to an initial position upon release of the lever handle.

13. The lever assembly of claim 8, wherein the lifting means further comprises a lift arm having a lobe engagable with a leaf spring attached to the trim housing, with the lobe of the lift arm disengaging from the leaf spring to strike the pin mechanism as the slider is moved in response to cam rotation when the door lever assembly is in its locked position.

* * * * *